United States Patent [19]

Matthews

[11] 3,975,012

[45] Aug. 17, 1976

[54] OVERLAPPED SHEET-FEEDING MACHINE

[75] Inventor: Merton Louis Matthews, Westerly, R.I.

[73] Assignee: Maxson Automatic Machinery Company, Westerly, R.I.

[22] Filed: Nov. 4, 1974

[21] Appl. No.: 520,368

[52] U.S. Cl. ..... 271/183; 271/202; 271/270

[51] Int. Cl.[2] ..... B65H 29/66

[58] Field of Search ..... 271/270, 231, 183, 182, 271/202, 195, 216; 83/88; 198/35

[56] References Cited

UNITED STATES PATENTS

| | | | |
|---|---|---|---|
| 2,625,394 | 1/1953 | Brown | 271/183 |
| 3,380,734 | 4/1968 | Laumer | 271/202 X |
| 3,779,545 | 12/1973 | Schuhmann et al. | 271/183 |

*Primary Examiner*—John J. Love
*Assistant Examiner*—Bruce H. Stoner, Jr.
*Attorney, Agent, or Firm*—Rines and Rines

[57] ABSTRACT

Collision between the tail and head ends of successive singly fed sheets to be overlapped is avoided by ejecting air along a frame sloped downwardly away from the line of feed of the sheets. The tail end of a preceding sheet is thus drawn down out of the path of the head end of a succeeding sheet which is to overlap the preceding sheet.

2 Claims, 5 Drawing Figures

Figure 1:
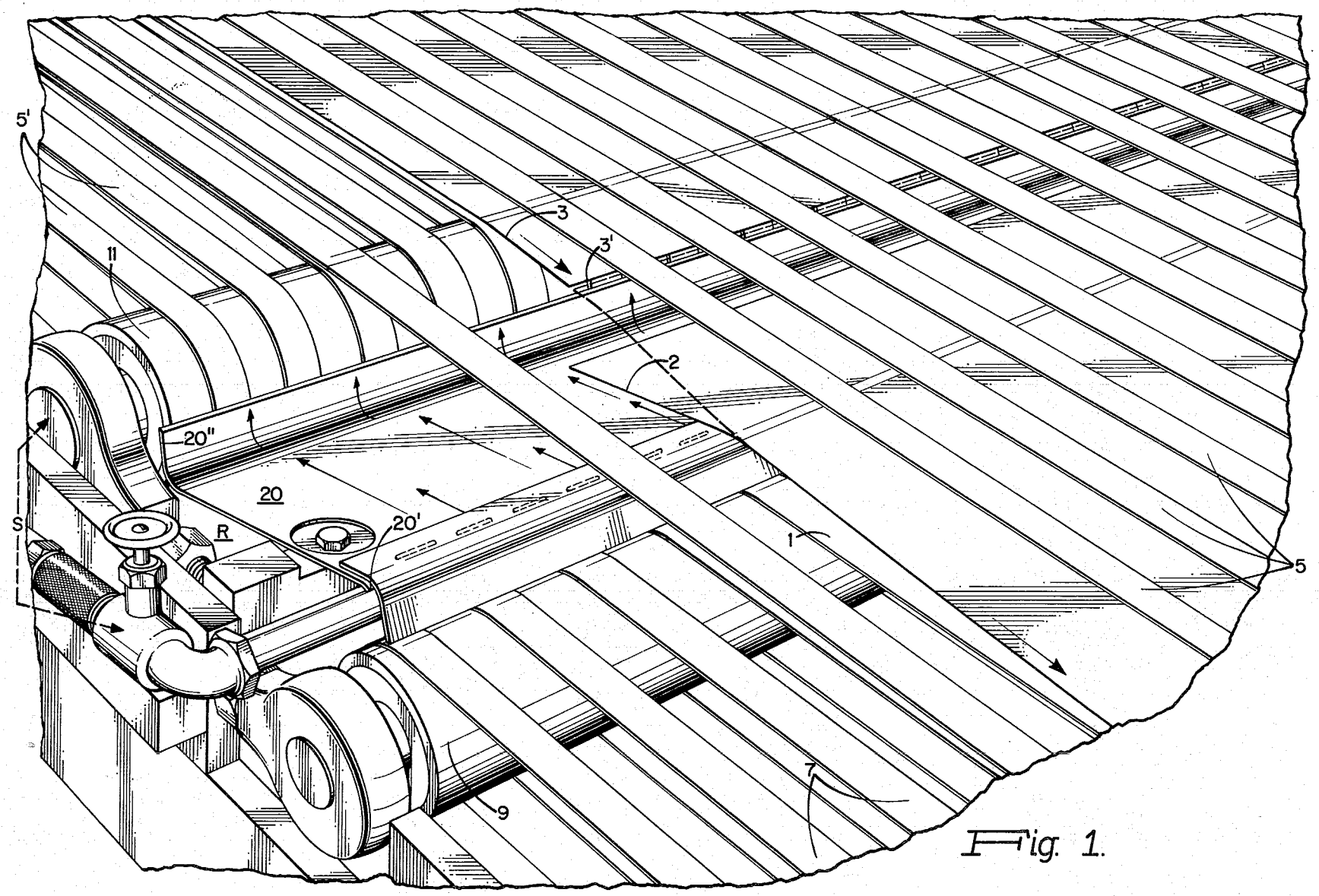

13
2'
7
1
1"
9
5
20'
2
20
R
3'
3
20"
5'
11

3'
2'
2"
3"
4'
4

S

OVERLAPPED SHEET-FEEDING MACHINE

The present invention relates to overlapped sheet-feeding method and machines, being more particularly, though not exclusively, directed to the feeding of paper, boxboard and similar sheet material.

For many years, numerous sheet-feeding apparatus have been employed for overlapped sheet-feed delivery, wherein improvement in the speed of the overlap has been attained by suction and compressed air and other techniques at the overlap point of the moving feed belts, apron or other conveyors of relative slow and fast speeds, as described, for example, in U.S. Letters Pat. Nos. 2,211,046; 2,205,767; 2,261,971; 2,261,972; 2,371,190; 2,399,445; 2,454,762; 2,501,836; 2,521,075; 2,757,929; 2,766,039; 2,906,530, and even as early as British Pat. No. 1562 to Wilkinson in 1859.

While improvement has been thus obtained, the art has had to endure substantial limitations in the upper operating speed limits with such techniques, particularly depending upon the lightness or heaviness of the sheet material used, and with consequent reliability limitations. Such overlap sections have, in some cases, therefore, been the limiting factor in speed and reliability of overall sheet-cutting and stacking and delivery systems such as, for example, those described in my prior U.S. Letter Pat. Nos. 3,703,117; 2,261,971 and other previously cited patents.

The normal operating speed of an overlapping system is to the greatest extent limited by the type of material being handled; light, flimsy materials, such as newsprint, having a maximum operating speed of 400 or so ft./min., while heavier materials, such as boxboard, easily handled at speeds of 1000 ft./min. or higher with the same overlapping system.

Two problems arise, however, particularly when handling the lighter materials.

First, the tail of the sheet delivered to the slow-moving belts or apron does not drop down fast enough, and the head end of the oncoming sheet collides with it. The reasons for failure to drop appear to be one or a combination of more than one of the following:

a. slight static problems;
b. stray air currents;
c. curl in material;
d. slippage of material somewhat reducing normal separation of sheets;
e. material bounces back; and
f. turbulence caused by sheet fanning as speeds increase.

Secondly, the overlapping principle using the slow down roll decreases the speed of the oncoming sheet by pushing the head end of the sheet down against the slower moving conveyor. This works well up to the point where the momentum of the entire sheet is such that when the head end slowed down the sheet tends to accordion or buckle on itself. Various devices such as corrugating shoes, mechanical grippers which grip the tail of the sheet, vacuum boxes which also slow the sheet from the rear, have all been used, as described in the above patents, with varying degrees of success to obtain additional feet per minute of running speed, by slowing the forward travel of the sheet from the rear as well, or in place of, slowing it from the leading edge. Known devices of this type have several disadvantages as follows:

a. have not effected large speed increments;
b. require careful placement and, therefore, greatly extend time-change for sizes;
c. cause physical damage to some highly sensitive materials;
d. are expensive to fabricate;
e. require considerable maintenance; and
f. increase timing problems.

An object of the present invention, accordingly, is to provide a new and improved method of and machine for overlapped sheet feeding that shall not be subject to the limitations above-discussed; but, to the contrary, shall, through obviating much of the above problems, enable substantial improvement and increase in speed and reliability at the point of overlap, particularly for thin or light weight sheets and the like.

A further object is to provide a novel sheet-feeding method and machine of more general applicability, as well.

Other and further objects will be explained hereinafter and are more particularly delineated in the appended claims.

In summary, however, from one of its view points, the invention embraces a method of avoiding collision between the tail and head ends of successive singly fed sheets, that comprises, feeding the sheets singly at relatively high speed from one position to a second position, receiving the head of each successive sheet at the second position and thereafter feeding the same at relatively low speed to overlap the successive sheets, and producing a region of pressure drop (preferably by appropriately directing a flow of air in a direction opposite to that of the sheet feeding) displaced from said positions of feed and intermediate the same to deflect the tail of each sheet passing thereover out of the line of feed of the head of the next successive sheet as the head of the deflected sheet is fed beyond said second position. Preferred constructional and other details are hereinafter presented.

The invention will now be described with reference to the accompanying drawings FIG. 1 of which is an isometric drawing illustrating a preferred embodiment of the invention; and FIGS. 2 through 5 are similar longitudinal sections of the machine of FIG. 1, showing successive positions of sheet-overlapping feed.

Referring to FIG. 1, upper and lower sets of relatively high speed tapes or other conveyors 5 and 5' (the latter shown passing over a final high-speed roll 11) are illustrated as feeding a sheet 3 therebetween from the left position to a region R where its head end 3' is to be delivered to bottom slow speed tapes or other conveyors 7 passing about a first slow speed roll 9 and located at a right-hand position. A previously received sheet 2 is shown being fed from the region R over a later-described air frame guide 20 with the head end 2' of sheet 2 (FIG. 2) received between the slow speed tapes 7 and a slow down roll with conventional slowdown pinch rings 13, to effect an overlap with its predecessor sheet 1, the tail end 1'' of which is shown carried along the slow speed tapes 7 under the sheet 2.

Figures 2, 3, 4, 5:
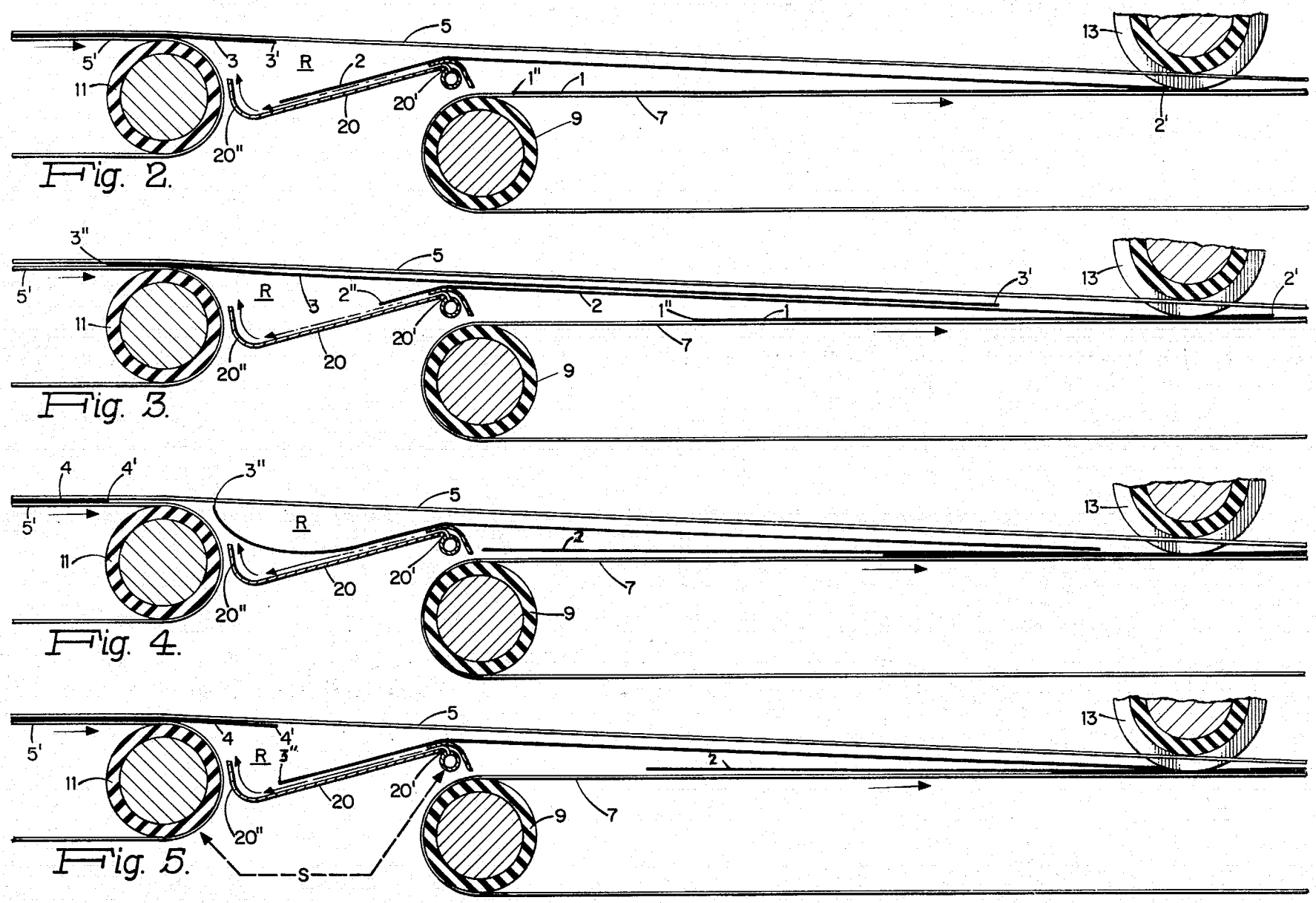

FIG. 3 shows the relative positions of the successive single sheets 3,2,1 at a next instant of time, when the tail end 1'' of the sheet 1 has moved more to the right on the low speed tapes 7 under the sheet 2 being overlapped thereupon, and the head end 2' of which has passed the slow down roll 13 and with the tail end 2'' moved upward further to the right over the air guide frame 20. The head end 3' of the sheet 3, meantime, has advanced to the right over the sheet 2 and is approaching the slow down roll 13, and the tail end 3'' is approaching the region R intermediate the high and low-speed tape positions.

As before explained, one of the problems underlying the present invention is preventing collision, particularly under conditions of high speed feeding of lightweight sheets, between the tail end 3'' when it reaches region R and starts to be overlapped upon the preceding sheet 2, and the head end 4' of the sheet 4 next following the sheet 3, FIG. 4. The present invention admirably solves this problem, enabling increased speed and reliability of operation by producing a pressure drop in the region R that will rapidly and positively deflect the tail of the sheet passing over the region R downward out of line of the head end of the next successive sheet from the high speed tape section. In the preferred embodiment this sheet deflecting pressure drop is effected through a judicious use of Bernoulli's principle in providing a high speed air current or jet ejected from nozzles 20' to move along the flat downwardly inclining portion of the air-guideing frame 20 substantially in the direction (to the left) opposite to the direction of feed of the sheets (to the right), as indicated by the arrows, to produce such a pressure drop with respect to the pressure of the surrounding slow moving or still air there-above. The downward deflection of the tail end 3'' of sheet 3 out of the line of feeding of the sheets is shown in FIGS. 4 and 5 under the action of this suction or pressure drop created by the arrowed air stream along the top surface of the guide frame 20. The upward guiding at the left-hand sharply upwardly extending lip 20'' of the air guide frame 20 serves also to direct the air straight upward, so that the leading or head end 4' of the next sheet 4 is held up against the tapes 5 as it initially leaves the high speed roll 11, FIG. 5, further preventing collision of the head end 4' and the downwardly held tail end 3'' of the previous sheet 3 and enabling high speed overlap. If such additional safeguard is not required, the lip 20'' could be directed downward (not shown) enabling an even further increase in overlapping speed.

The downward sloping of the air guide 20 away from the line of feed from a location below and close to the line of feed provides room for the leading edge of the oncoming sheet to pass over the trailing edge of the previous sheet, with the downstream surface of the air frame close to the path of the oncoming sheet such that the air starts to work on it at this point. The action of the air is extremely fast and the tail is pulled down parallel to the air frame 20 before the head end of the oncoming sheet arrives. The head end of this sheet is held up and floated over the tail of the previous sheet by the upward directed exhaust of air from the air frame at 20''.

The reverse thrust or braking action produced on the sheet because of the friction between the sheet and fast moving current of air that it is being pushed into by the denser pressure above the sheet is quite considerable, and conventional automatic flow controls are useful, with the flow synchronized with speed such that no air flows until the machine has reached a predetermined minimum speed, as schematically shown at S.

Further modifications will also occur to those skilled in the art, such falling within the spirit and scope of the invention as defined in the appended claims.

What is claimed is:

1. A machine for feeding sheets comprising means for feeding the sheets singly at relatively high speed along a line of feed from one position to a second position, means for receiving the head of each successive sheet at the second position and thereafter feeding the same at relatively low speed to overlap the successive sheets, means disposed intermediate said positions below said line of feed for ejecting air from a location close to said line of feed in a direction substantially opposite to the direction of said line of feed and away from said line of feed to create a pressure drop that deflects the tail of each sheet passing over said air to attract the same out of the line of feed of the head of the next successive sheet as the receiving means feeds the head of the deflected sheet beyond said second position, said ejecting means comprising an air guide frame downwardly sloping from said location and away from the line of feed and substantially in said opposite direction.

2. A machine as claimed in claim 1 in which said air guide frame rises upwardly toward said line of feed at an end of said guide frame remote from said location.

* * * * *